US007428901B2

(12) United States Patent
Gama et al.

(10) Patent No.: US 7,428,901 B2
(45) Date of Patent: Sep. 30, 2008

(54) COOKING STOVE

(75) Inventors: Atsuhito Gama, Nagoya (JP); Shinichiro Hata, Nagoya (JP); Hiroyuki Yamada, Nagoya (JP); Kazuya Hirota, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 464 days.

(21) Appl. No.: 11/113,990

(22) Filed: Apr. 26, 2005

(65) Prior Publication Data

US 2005/0235983 A1 Oct. 27, 2005

(30) Foreign Application Priority Data

Apr. 27, 2004 (JP) ..... 2004-130600

(51) Int. Cl.
*F24C 3/00* (2006.01)
*H05B 3/68* (2006.01)

(52) U.S. Cl. ..... 126/39 BA; 126/39 R; 700/90; 219/445.1; 219/446.1; 219/447.1; 219/448.11; 431/18; 431/24; 431/25; 431/27; 431/66; 431/67; 431/70; 431/73

(58) Field of Classification Search ..... 126/39 BA, 126/39 E; 219/445.1, 446.1, 447.1, 448.11, 219/448.12, 448.13; 431/18, 24–5, 27, 29, 431/66–73; 700/90
See application file for complete search history.

(56) References Cited

U.S. PATENT DOCUMENTS

| | | | |
|---|---|---|---|
| 4,391,265 | A | 7/1983 | Chen |
| 2004/0256378 | A1 | 12/2004 | Shukla |

FOREIGN PATENT DOCUMENTS

| | | | |
|---|---|---|---|
| DE | 102 03 614 | A1 | 7/2003 |
| EP | 0 729 292 | A1 | 8/1996 |
| EP | 1 344 981 | A2 | 9/2003 |
| JP | 58-186302 | U | 12/1983 |
| JP | 04-093525 | | 3/1992 |
| JP | 7-44816 | | 2/1995 |
| JP | 2003-303674 | | 10/2003 |

*Primary Examiner*—Shawntina Fuqua
(74) *Attorney, Agent, or Firm*—Birch, Stewart, Kolasch & Birch, LLP

(57) ABSTRACT

A cooking stove that prevents the execution of a process such as ignition of a burner when a touch switch changes from a non-sensing state to a sensing state. In STEP201, when a first touch switch, which is one of the touch switches provided in an operation, is turned on from off, the process advances to STEP202, where a controller provided in a cooking stove main body starts a 1-second timer. The controller executes a loop composed of STEP203 and STEP210. When a second touch switch, which is one of the touch switches and is different from the first touch switch, is turned on from off in STEP210 before the 1-second timer times up in STEP203, the process advances from STEP210 to STEP211. The controller performs "error reporting" by blinking a display portion and activating a buzzer.

12 Claims, 15 Drawing Sheets

COOKING STOVE

BACKGROUND OF THE INVENTION

1. Field of the Invention

The present invention relates to a cooking stove comprising heating means, and in particular, to a cooking stove comprising an operation portion provided on a top surface of a top plate to instruct the heating means to be actuated.

2. Description of the Related Art

A drop-in type cooking stove has hitherto been known in which a cooking stove main body 101 is embedded in an opening formed at a counter top of a system kitchen as shown in FIG. 15. In this cooking stove, operation knobs 103*a* and 103*b* are provided on a glass top plate 102 covering a top surface of the cooking stove main body 101, in which the gas burners 100*a* and 100*b* are accommodated; the operation knobs 103*a* and 103*b* are used to ignite and extinguish the gas burners 100*a* and 100*b* and to adjust the heating power of the gas burners 100*a* and 100*b* (see, for example, Japanese Utility Model Laid-Open No. 58-186302).

Such a cooking stove does not require an opening in a front surface of the counter top so that a user can access an operation portion through the opening. A cooking stove can be easily installed at the counter top. The gas burners can be ignited or extinguished or their heating power adjusted using the operation knobs 103*a* and 103*b*, provided on the top plate 102 and seen easily by a user. This enables the user to operate the cooking stove easily and efficiently.

In the cooking stove shown in FIG. 15, the operation knobs 103*a* and 103*b* are arranged on and projected from the top surface of the glass top plate 102, obstructing cooking. It is thus conceivable to flatten the top surface of the glass top plate 102 by constructing, as means for operating the gas burners 100*a* and 100*b*, a touch switch comprising a detecting portion composed of an electrical capacitance sensor and provided on a back surface of the glass top plate 102 and an operation portion provided on a front surface of the glass top plate 102.

However, if the touch switch is thus provided, it may be turned on when covered with a cooking material boiling over from a pan placed on a trivet 104*a* or 104*b* or an object having fallen on the glass top plate 102. Then, when the user is cooking using, for example, only the right burner 100*b*, an ignition switch for the left burner 100*a* may be turned on by a cooking material boiling over from a pan placed on the trivet 104*b* of the right burner 100*b*. Thus, disadvantageously, the left burner 100*a* is ignited.

It is thus an object of the present invention to eliminate such a disadvantage and to provide a cooking stove that prevents the execution of a process such as ignition of a burner when a touch switch changes from a non-sensing state to a sensing state owing to a factor different from the user's operation.

SUMMARY OF THE INVENTION

The present invention is made to accomplish the above object. The present invention relates to improvements in a cooking stove comprising a plurality of touch switches provided on a top plate so that a user can operate the touch switches, the top plate covering a top surface of a cooking stove main body accommodating heating means, the touch switches sensing an object which contacts or approaches the top surface of the top plate, and control means for determining whether each of the touch switches is in a sensing state or a non-sensing state, and executing a predetermined process which is set for each of the touch switches according to the determined results.

The control means according to a first aspect is characterized as follows. When a first touch switch in the plurality of touch switches changes from the non-sensing state to the sensing state, the control means inhibits a predetermined process set for the first touch switch from being executed until a predetermined time passes after the first touch switch changes to the sensing state. When a second touch switch in the plurality of touch switches which is different from the first touch switch changes from the non-sensing state to the sensing state before the predetermined time passes, the control means inhibits execution of the predetermined process set for the first touch switch and a predetermined process set for the second touch switch. When all the touch switches except the first touch switch are kept in the non-sensing state until the predetermined time passes, the control means executes the predetermined process set for the first touch switch.

According to this aspect of the invention, the plurality of touch switches are provided in proximity to each other. Thus, if any cooking material boils over, it is unlikely to cover only one switch. At least two touch switches are likely to be covered with the boiling-over cooking material. Thus, when the second touch switch, which is different from the first touch switch, changes from the non-sensing state to the sensing state after the first touch switch has changed from the non-sensing state to the sensing state and before the predetermined time passes, the control means inhibits the execution of the predetermined processes set for the first and second touch switches.

This makes it possible to prevent the execution of the predetermined processes set for the two touch switches when the two touch switches transition from the non-sensing state to the sensing state owing to a factor different from the user's operation, for example, a boiling-over cooking material.

Further, the control means according to a second aspect of the present invention is characterized as follows. When a first touch switch in the plurality of touch switches changes from the non-sensing state to the sensing state, the control means inhibits a predetermined process set for the first touch switch from being executed until the first touch switch changes from the sensing state to the non-sensing state. When a second touch switch in the plurality of touch switches which is different from the first touch switch changes from the non-sensing state to the sensing state before the first touch switch changes from the sensing state to the non-sensing state, the control means inhibits execution of the predetermined process set for the first touch switch and a predetermined process set for the second touch switch. When all the touch switches except the first touch switch are kept in the non-sensing state until the first touch switch changes from the sensing state to the non-sensing state, the control means executes the predetermined process set for the first touch switch.

According to this aspect of the invention, when the second touch switch changes from the non-sensing state to the sensing state when the first touch switch has changed from the non-sensing state to the sensing state and before the first touch switch changes from the sensing state to the non-sensing state, the control means inhibits the execution of the predetermined processes set for the first and second touch switches.

Thus, when any of the plurality of touch switches changes from the non-sensing state to the sensing state owing to a factor different from the user's operation, for example, a boiling-over cooking material, it is possible to prevent the execution of the predetermined process set for the touch switch.

The cooking stove is also characterized by further comprising an actuation start switch included in the plurality of touch switches for an instruction on start of actuation of the heating means, and in that the first or second touch switch is the actuation start switch, and the predetermined process set for the actuation start switch is a process for starting actuation of the heating means.

This aspect of the invention makes it possible to prevent the execution of the process for starting actuation of the heating means when the actuation start switch changes from the non-sensing state to the sensing state owing to a factor different from the user's operation, for example, a boiling-over cooking material.

The cooking stove is also characterized by further comprising heat quantity varying means for varying heat quantity generated by the heating means, and a heat quantity varying switch included in the plurality of touch switches for an instruction on varying heat quantity generated by the heating means, and in that the first touch switch or the second touch switch is the heat quantity varying switch, and the predetermined process set for the heat quantity varying switch is a process for varying heat quantity generated by the heating means using the heat quantity varying means.

This aspect of the invention makes it possible to prevent the heating means from varying heat quantity generated by the heating means when the heat quantity varying switch changes from the non-sensing state to the sensing state owing to a factor different from the user's operation, for example, a boiling-over cooking material.

The cooking stove is also characterized by further comprising an actuation start switch included in the plurality of touch switches for an instruction on start of actuation of the heating means, and an actuation start ready switch included in the plurality of switches to give an instruction on switching between an actuation start ready state in which it is permitted to instruct on start of actuation of the heating means using the actuation start switch and an actuation start disabled state in which it is prohibited to instruct on start of actuation of the heating means using the actuation start switch, and in that the first touch switch or the second touch switch is the actuation start ready switch, and the predetermined process set for the actuation start ready switch is a process for switching between the actuation start ready state and the actuation start disabled state.

This aspect of the invention makes it possible to prevent the execution of the process for switching between the actuation start ready state and the actuation start disabled state when the actuation start ready switch changes from the non-sensing state to the sensing state owing to a factor different from the user's operation, for example, a boiling-over cooking material. In particular, by preventing the actuation start disabled state from being switched to the actuation start ready state, it is possible to maintain a state in which the actuation start switch cannot be used to give an instruction on the start of actuation of the heating means.

The cooking stove is characterized in that at least two of the plurality of touch switches are arranged around the actuation start switch in proximity to each other.

According to this aspect of the invention, when a cooking material flows from around the periphery of the actuation start switch to this switch, the actuation start switch and another switch placed around the periphery of the touch switch change from the non-sensing state to the sensing state. Thus, when any cooking material boils over, the control means inhibits the process for starting the actuation of the control means, which is the predetermined process set for the actuation start switch. This makes is possible to prevent the process for starting the actuation of the heating means from being executed owing to a boiling-over cooking material.

DETAILED DESCRIPTION OF THE PREFERRED EMBODIMENTS

Figure 1A:
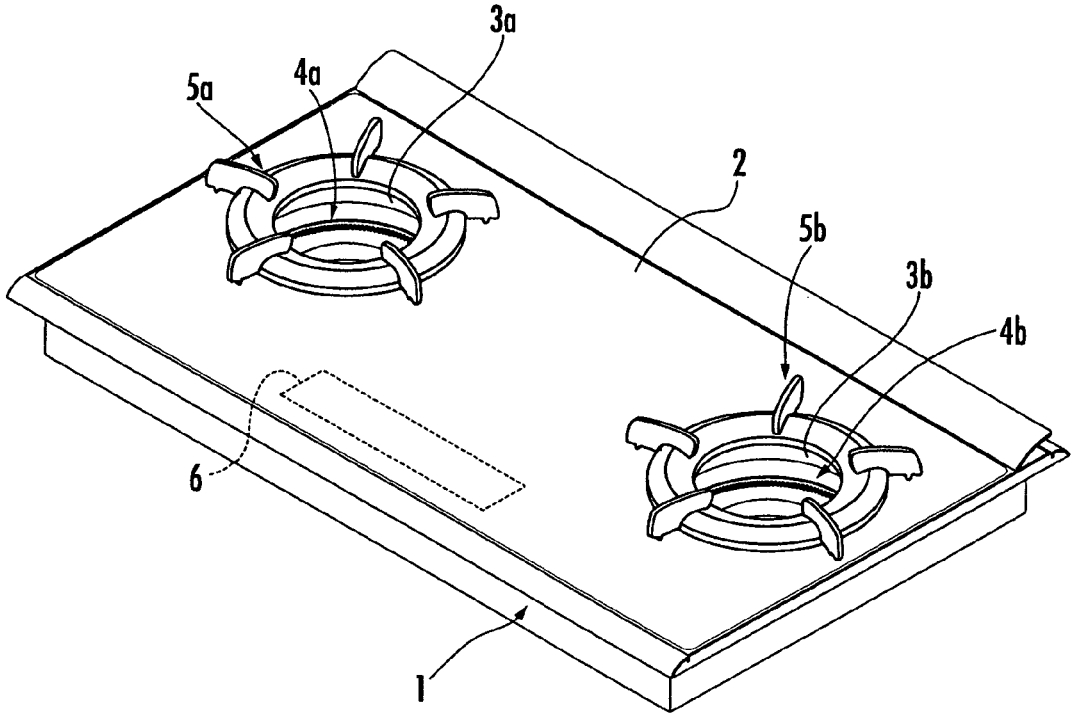
FIG. 1 is a diagram showing the appearance of a cooking stove according to the present invention.
Figure 1B:
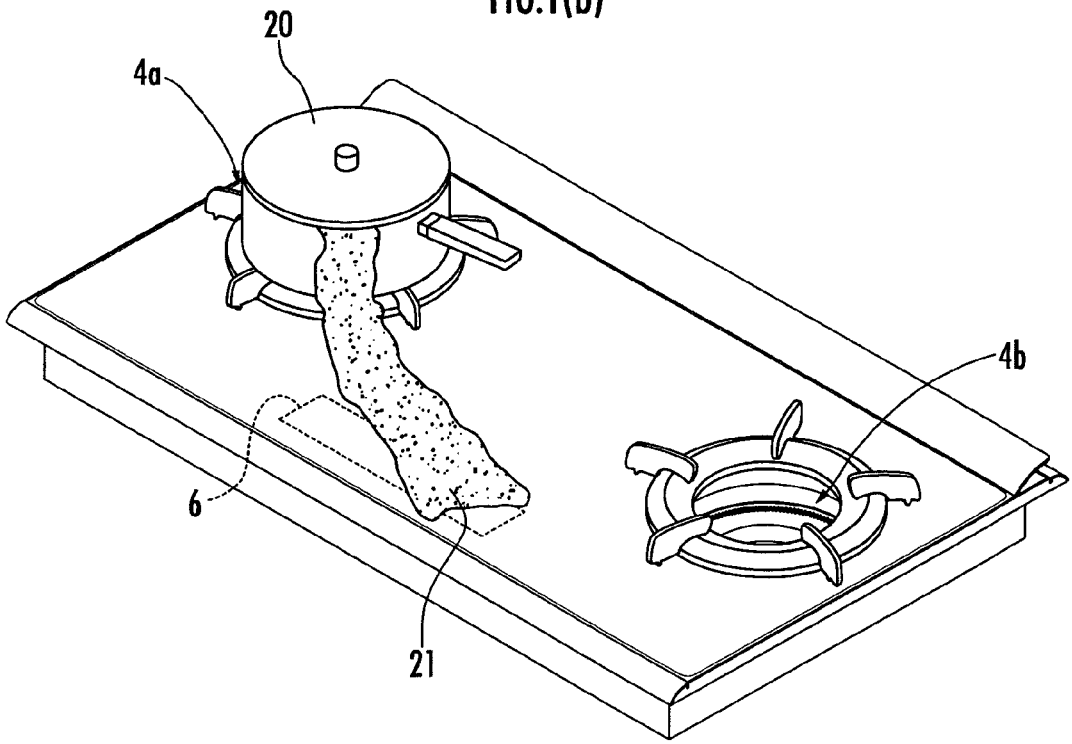
Figure 2:
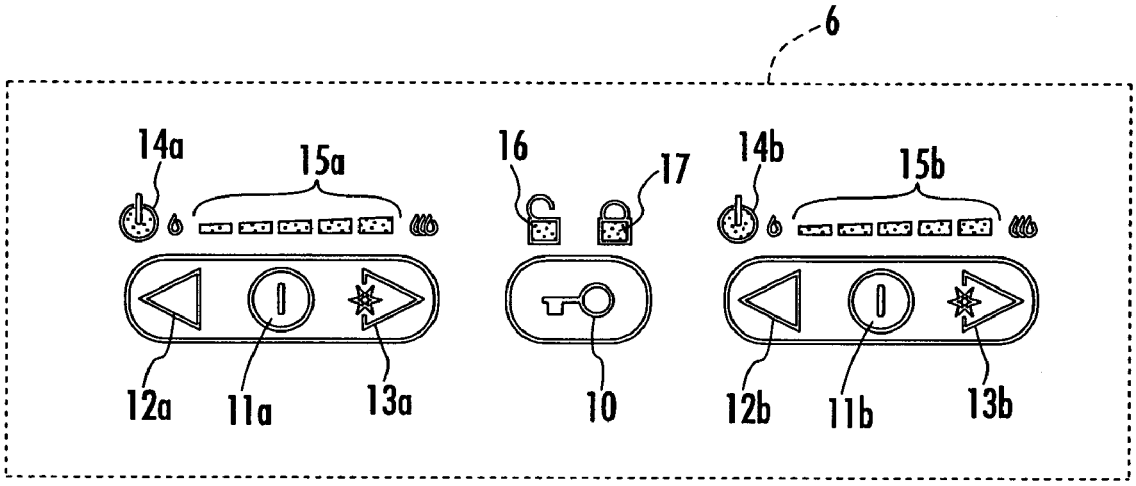
FIG. 2 is a detailed diagram of an operation portion shown in FIG. 1.
Figure 3:
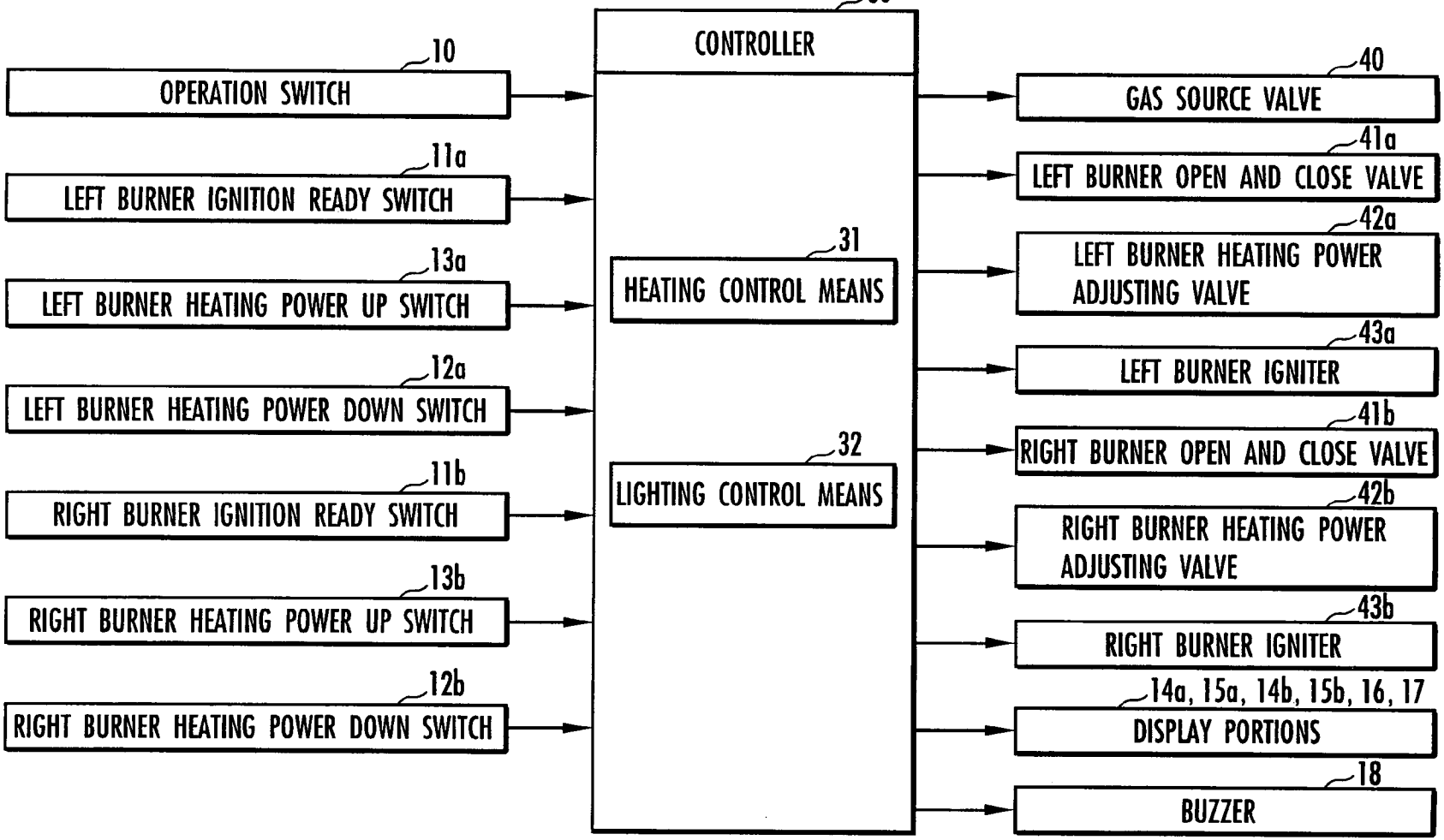
FIG. 3 is a control block diagram of the cooking stove.
Figure 12:
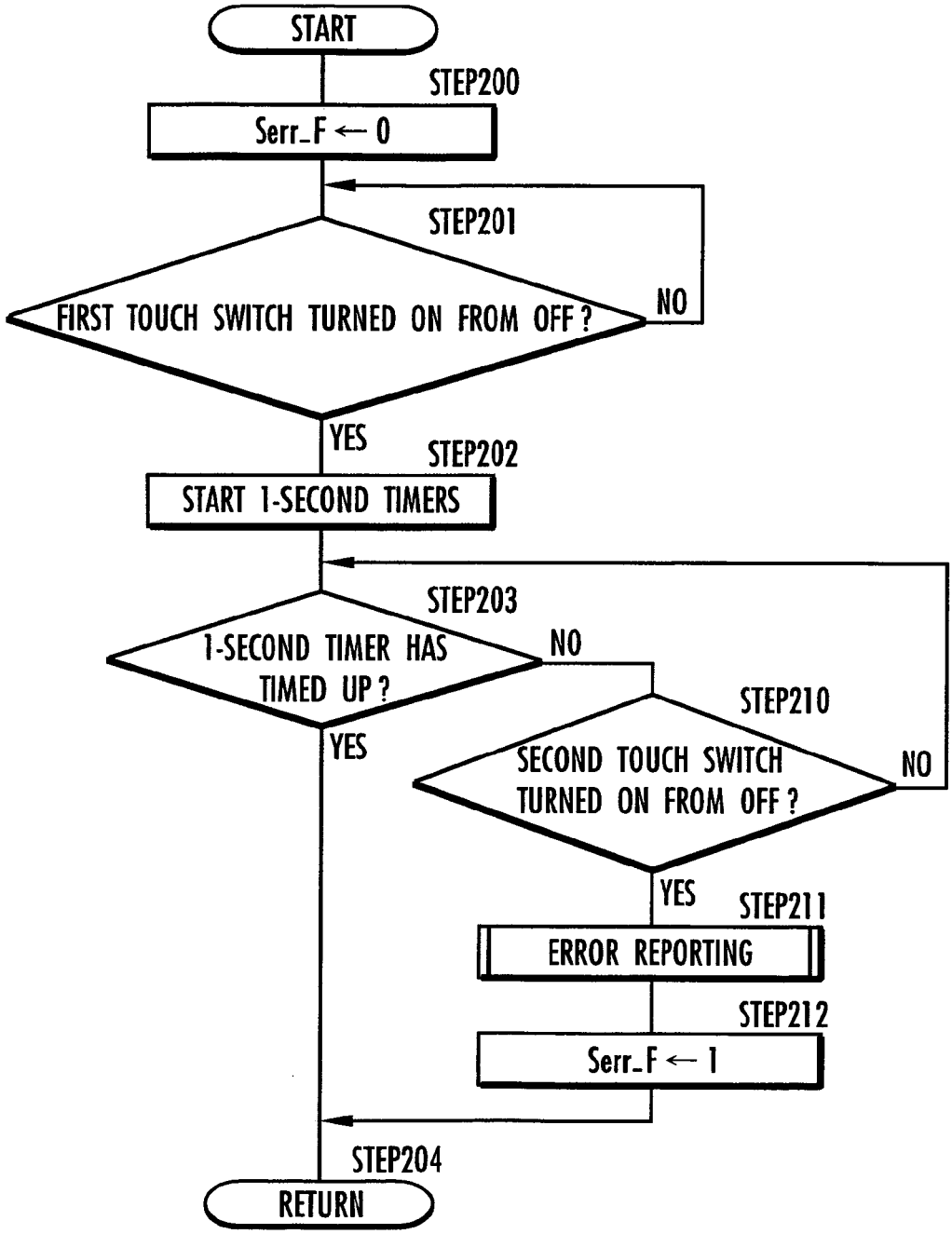
FIG. 12 is a flowchart of a switch input sensing process.
Figure 13:
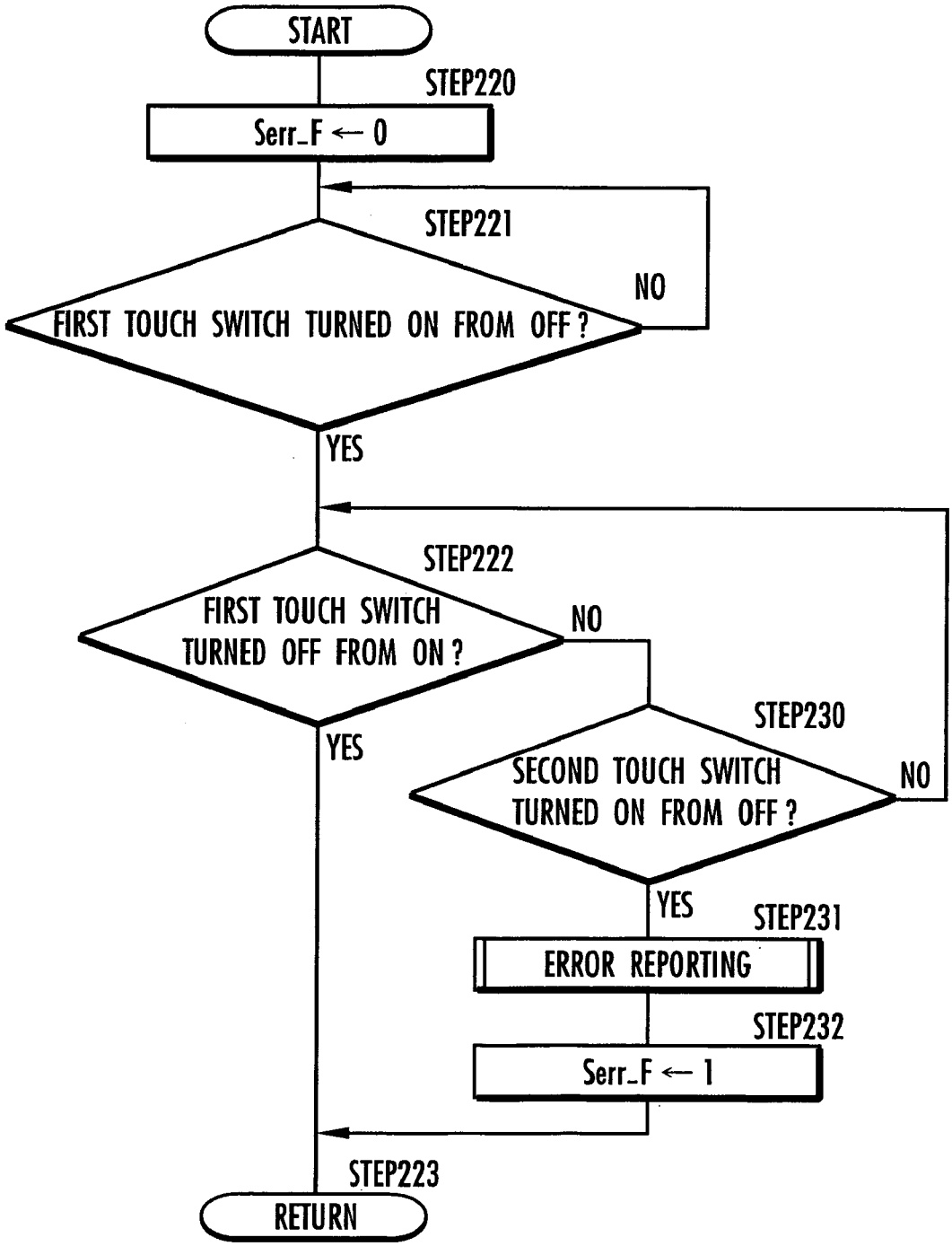
FIG. 13 is a flowchart of the switch input sensing process.
Figure 14A:
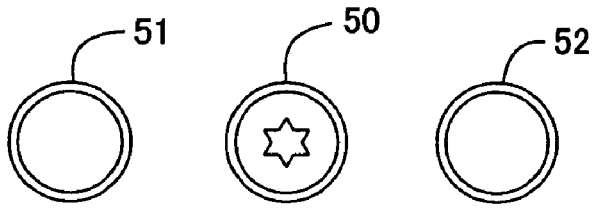
FIG. 14 is a diagram showing how ignition switches are arranged.
Figure 14B:
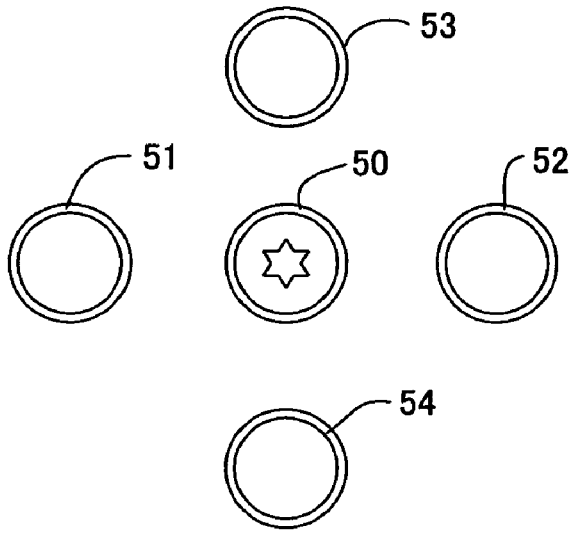
Figure 15:
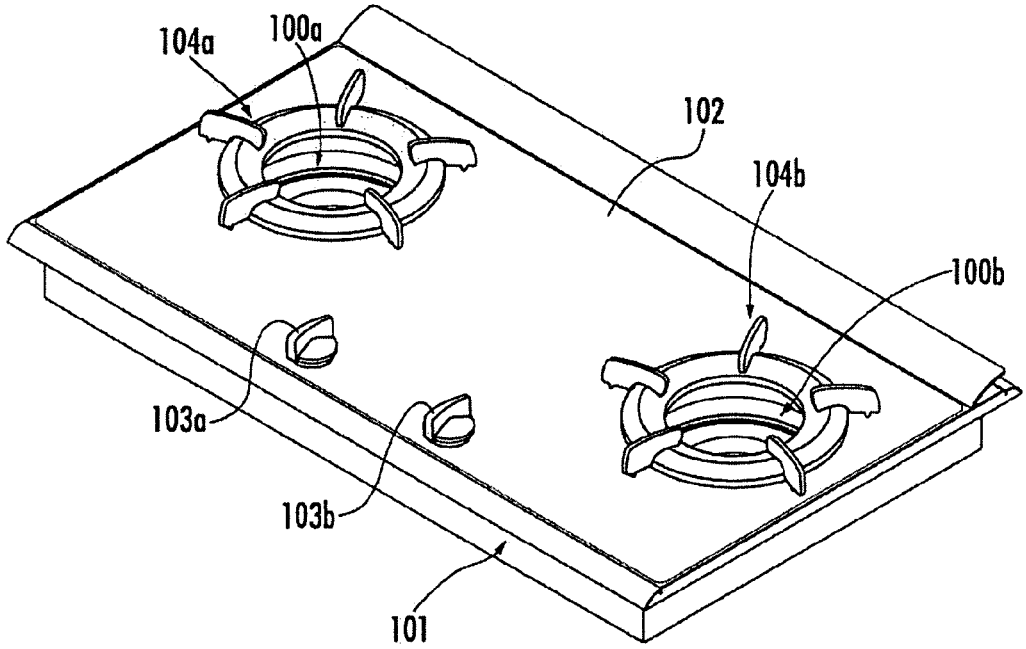
FIG.15 PRIOR ART
FIG. 15 is a diagram showing the appearance of a conventional cooking stove.

Embodiments of the present invention will be described with reference to FIGS. 1 to 13. FIG. 1 is a diagram showing the appearance of a cooking stove according to the present invention. FIG. 2 is a detailed diagram of an operation portion shown in FIG. 1. FIG. 3 is a control block diagram of the cooking stove. FIGS. 4 to 7 are flowcharts of a process for igniting a burner. FIGS. 8 to 11 are flowcharts of various processes executed while a burner is in operation. FIGS. 12 and 13 are flowcharts of an input sensing process for touch switches. FIG. 14 is a diagram showing how ignition switches are arranged.

FIG. 1 shows a drop-in type cooking stove in which a glass top plate 2 is installed on a top surface of a cooking stove main body; the glass top plate 2 is formed of crystallized glass, which extremely resists heat. A lateral pair of cooking stove openings 3*a* and 3*b* are formed in the glass top plate 2. A left burner 4*a* and a right burner 4*b* (corresponding to heating means according to the present invention) are provided in the cooking stove main body 1 so as to face the cooking stove openings 3*a* and 3*b*. Further, trivets 5*a* and 5*b* are provided on the cooking stove openings 3*a* and 3*b*, respectively, so that a cooking container can be placed on the trivet 5*a* or 5*b*. An operation portion 6 is provided in the front of the top surface of the glass top plate 2 to instruct the left burner 4*a* and the right burner 4*b* to be actuated.

With reference to FIG. 2, the operation portion 6 comprises an operation switch 10 that switches the cooking apparatus between an "operation state" in which it is possible to instruct the left burner 4*a* and the right burner 4*b* to be actuated and a "standby state" in which it prohibited to instruct the left burner 4*a* and the right burner 4*b* to be actuated. Further, to instruct the left burner 4*a* to be actuated, the operation portion 6 is also provided with an ignition ready switch 11*a* (corresponding to an actuation start ready switch according to the present invention) that brings the left burner 4*a* into an ignition ready state (corresponding to an actuation start ready state according to the present invention), a heating power down switch 12*a* (corresponding to a heat quantity varying switch according to the present invention) and a heating power up switch 13*a* (corresponding to a heat quantity varying switch according to the present invention) that switch the heating power of the left burner 4*a* among five levels (levels 1 to 5), an ignition ready display portion 14*a* lighted while the left burner 4*a* is ready for ignition and while the left burner 4*a* is in operation, and a heating power level display portion 15*a* that displays a heating power setting for the left burner 4*a*.

When the heating power up switch 13*a* is operated while the left burner 4*a* is ready for ignition, a process for igniting the left burner 4*a* is executed (in this case, the heating power up switch 13*a* corresponds to an actuation start switch according to the present invention). When the ignition ready switch 11*a* or the operation switch 10 is operated, a process for extinguishing the left burner 4*a* is executed.

Similarly, to instruct the right burner 4*b* to be actuated, the operation portion 6 is also provided with an ignition ready switch 11*b* (corresponding to an actuation start ready switch according to the present invention) that brings the right burner 4*b* into an ignition ready state (corresponding to an actuation start ready state according to the present invention), a heating power down switch 12*b* (corresponding to a heat quantity varying switch according to the present invention) and a heating power up switch 13*b* (corresponding to a heat quantity varying switch according to the present invention) that switch the heating power of the left burner 4*b* among five levels (levels 1 to 5), an ignition ready display portion 14*b* lighted while the left burner 4*b* is ready for ignition and while the left burner 4*b* is in operation, and a heating power level display portion 15*b* that displays a heating power setting for the left burner 4*b*.

When the heating power up switch 13*b* is operated while the left burner 4*b* is ready for ignition, a process for igniting the left burner 4*b* is executed (in this case, the heating power up switch 13*b* corresponds to an actuation start switch according to the present invention). When the ignition ready switch 11*b* or the operation switch 10 is operated while the right burner 4*b* is in operation, a process for extinguishing the left burner 4*b* is executed.

Moreover, the operation portion 6 comprises an unlock display portion 16 lighted while the cooking stove is in the "operation state", and a lock display portion 17 lighted when the operation switch 10 is operated for a predetermined time (for example, 4 seconds) to bring the cooking stove into what is called a child lock state in which none of the switches can be operated.

An operation start disabled state according to the present invention corresponds to the state in which it is prohibited to instruct the left burner 4*a* and right burner 4*b* to be ignited using the heating power switches 13*a* and 13*b* before the ignition ready switch 11*a* or 11*b* is operated to get the burner ready for ignition.

Each of the switches in the operation portion 6 is a contactless touch switch composed of an electrical capacitance sensor provided on the back surface of the glass top plate 2 and a print portion printed on that part of a front surface of the glass top plate 2 which is opposite to the electrical capacitance sensor, the print portion showing a touch point of the switch. When an electrostatic object is placed in the print portion (that part of the front surface of the glass top plate 2 which is opposite to the electrical capacitance sensor), the electrical capacitance sensor detects the electrostatic object to turn on the touch switch (this corresponds to a sensing state according to the present invention). On the other hand, when an electrostatic object is not placed in the print portion, the electrical capacitance sensor does not detect the electrostatic object and the touch switch is turned off (this corresponds to a non-sensing state according to the present invention).

Further, each of the display portions of the operation portion 6 is composed of a LED provided on the back surface of the glass top plate 2, and a print portion printed on that part of the front surface of the glass top plate 2 which is opposite to the LED. The display portion is lighted when the LED is turned on, and is extinguished when the LED is turned off.

The heating power level display portion 15*a* shows the heating power level (levels 1 to 5) of the left burner 4*a* on the basis of the number of lighting portions in an illustrated bar display which are sequentially lighted starting with the leftmost one; the total number of lighting portions is five. For example, when the left burner 4*a* has a heating power level of 1, only the lighting portion at the left end of the bar display is lighted. When the left burner 4*a* has a heating power level of 5, all the five lighting portions of the bar display are lighted. Likewise, the heating power level display portion 15*b* shows the heating power level (levels 1 to 5) of the right burner 4*b* on the basis of the number of lighting portions in an illustrated bar display which are sequentially lighted starting with the leftmost one; the total number of lighting portions is five.

With reference to FIG. 3, a controller 30 (corresponding to control means according to the present invention) is provided in the cooking stove main body 1 to control the actuation of the whole cooking stove. A sensing signal for the operation state (on/off) of each switch (operation switch 10, ignition ready switches 11*a* and 11*b*, heating power down switches 12*a* and 12*b*, and heating power up switches 13*a* and 13*b*) of the operation portion 6 is input to the controller 30.

Control signals output by the controller 30 control the actuation of a gas source valve 40 that allows or inhibits the supply of fuel gas to the cooking stove main body 1, a left burner open and close valve 41*a* that allows or inhibits the supply of fuel gas to the left burner 4*a*, a left burner heating power adjusting valve 42*a* (corresponding to heat quantity varying means according to the present invention) that varies the flow rate of fuel gas supplied to the left burner 4*a*, a left burner igniter 43*a* that applies a high voltage to an ignition electrode (not shown) for the left burner 4*a* to cause spark discharge, a right burner open and close valve 41*b* that allows or inhibits the supply of fuel gas to the right burner 4*b*, a right burner heating power adjusting valve 42*b* (corresponding to heat quantity varying means according to the present invention) that varies the flow rate of fuel gas supplied to the right burner 4*b*, and a right burner igniter 43*b* that applies a high voltage to an ignition electrode (not shown) for the right burner 4*b* to cause spark discharge.

Control signals output by the controller 30 control the lighting and extinction of each display portion (ignition ready display portions 14*a* and 14*b*, heating power level display portions 15*a* and 15*b*, unlock display portion 16, and a lock display portion 17) provided in the operation portion 6 and turn-on and -off of a buzzer 18.

The controller 30 comprises heating control means 31 for controlling the actuation of the left burner 4*a* and right burner 4*b* and lighting control means 32 for controlling the lighting and extinction of each display portion in the operation portion 6 and causing the buzzer 18 to give warning.

As described above, the touch switches provided in the operation portion 6 sense whether or not any electrostatic object is present on the top surface of the glass top plate 2. Thus, even if the user does not touch any touch switch with his or her finger, while the user is heating a cooking material in a pan 20 using only the left burner 4*a*, the cooking material may boil over and the boiling-over cooking material 21 may reach the operation portion 6 to turn on the touch switch for the right burner 4*b* as shown in FIG. 1(*b*). In another situation, the touch switch maybe turned on when the operation portion 6 may be covered with an object (cloth, cooking material, or the like) having fallen on the glass top plate 2 or with a cooking container placed on the glass top plate 2.

Thus, when the touch switch is turned on from off by a factor different from the user's operation, the controller 30 executes a process required to inhibit acceptance of an instruction on operation of the left burner 4*a* or right burner 4*b*. This process will be described with reference to the flowcharts shown in FIGS. 4 to 13. The following description relates to the left burner 4*a*. However, a similar process is executed on the right burner 4*b*.

FIGS. 4 to 7 show processing required for an operation of igniting the left burner 4*a*. When the cooking stove 30 is powered on, the controller 30 starts to be actuated and enters a "standby state". In STEP1 in FIG. 4, the controller 30 executes a subroutine "switch sensing process".

FIG. 12 is a flowchart of the subroutine "switch sensing process". In STEP200, the controller 30 resets a sensing error flag Serr_F (Serr_F=0) that is set when the controller 30 determines that any touch switch in the operation portion 6 has performed erroneous sensing. Then, in STEP201, the controller 30 waits for a first touch switch, one of the switches provided in the operation portion 6, to be turned on from off.

In STEP201, when the first touch switch is turned on from off, the process advances from STEP201 to STEP202. The controller 30 then starts a 1-second timer. Then, the controller 30 executes a loop consisting of STEP203 and STEP210. Until the 1-second timer times up in STEP203, the controller 30 determines in STEP210 whether or not a second touch switch has been turned on from off, the second touch switch being one of the touch switches provided in the operation portion 6 and which is different from the first touch switch.

In STEP210, when the second touch switch is turned on from off, the two touch switches in the operation portion 6 are both on. In this case, it is assumed that the two touch switches are on because the operation portion 6 is covered with boiling-over cooking material or the like and not because of the user's operation. Thus, the process advances to STEP211, where the controller 30 performs "error reporting" by blinking the lighting ready display portion 14*a* and activating the buzzer 18. This warns the user that for example, a cooking material is boiling over. In STEP212, the controller 30 sets the error sensing flag Serr_F (Serr_F=1). The process then advances to STEP204, where the controller 30 finishes a"switch sensing process".

On the other hand, in STEP203, when the 1-second timer times up, only the first touch switch in the operation portion 6 is on. In this case, it is assumed that the first touch switch has been turned on by the user's operation. The process then advances to STEP204 without setting the error sensing flag Serr_F. The controller 30 thus finishes the "switch sensing process".

Figure 4:
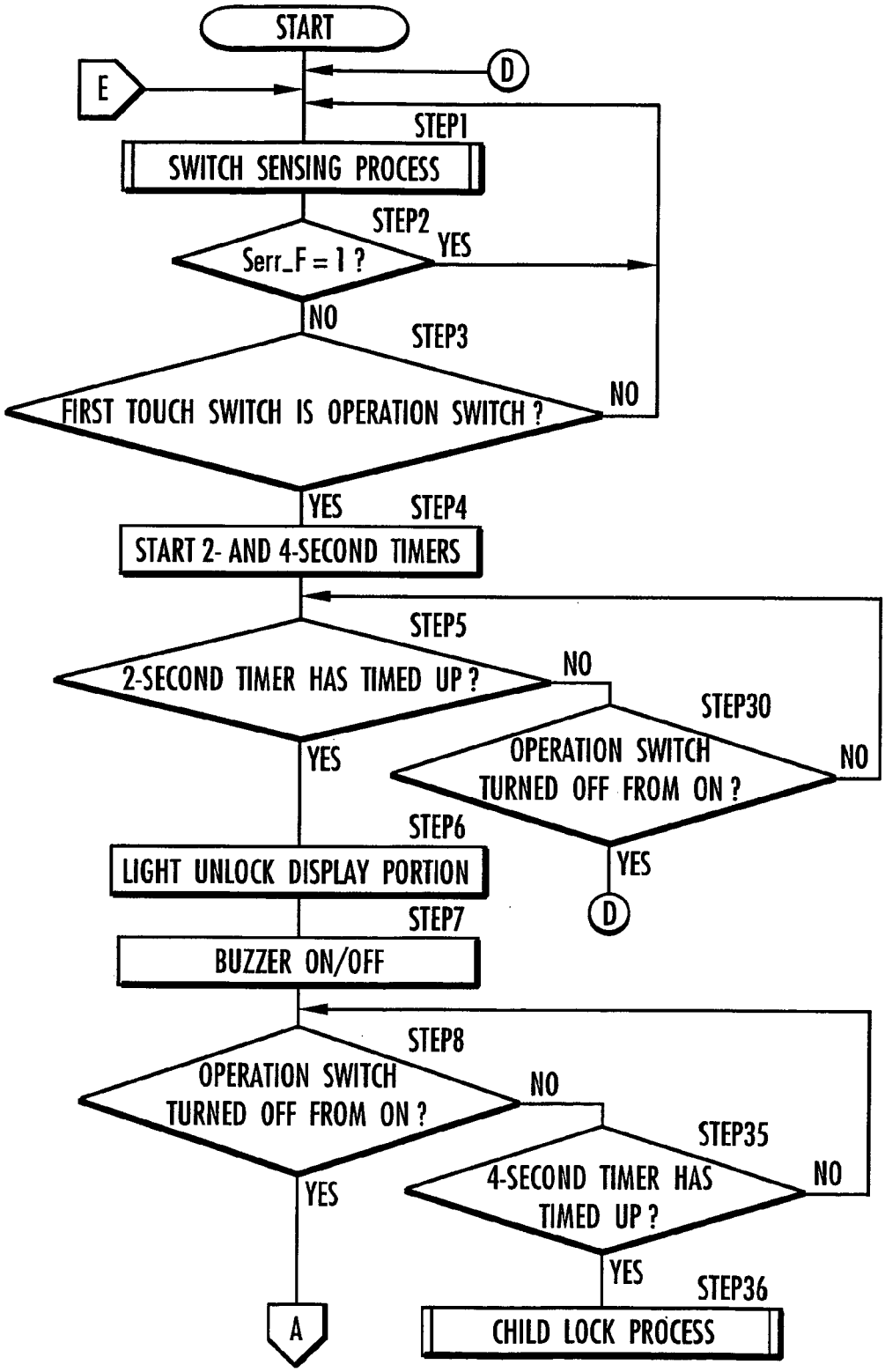
FIG. 4 is a flowchart of a process for igniting a burner.

In STEP2 in FIG. 4, if the error sensing flag Serr_F has been set (Serr_F=1) and any touch switch has performed erroneous sensing, the process returns to STEP1. The controller 30 then does not execute the processing starting with STEP3. On the other hand, in STEP2, if the error sensing flag Serr_F has been reset (Serr_F=0), the process advances to STEP3. The controller 30 then determines whether or not the first touch switch in the "switch sensing process" in STEP1 is the operation switch 10.

When the first touch switch is not the operation switch 10, the process branches to STEP1. The controller 30 does not execute the processing starting with STEP4. Thus, the cooking stove is kept in the "standby state". On the other hand, in STEP3, when the first touch switch is the operation switch 10, the process advances to STEP4. The controller 30 then starts a 2-second timer and a 4-second timer.

Then, in a loop consisting of STEP5 and STEP30, the process advances to STEP6 when the operation switch 10 is not turned off from on in STEP3 and the 2-second timer times up in STEP5, that is, when the operation switch 10 is turned on from off in STEP201 in FIG. 12 and then remains on for at least 3 seconds. When the operation switch 10 is turned off from on in STEP30 before the 2-second timer times up, the process returns to STEP1. The cooking stove then maintains the "standby state".

The controller 30 then lights the unlock display portion 16 in STEP6 and activates the buzzer 18 in STEP7. The process then advances to STEP8. In a loop consisting of STEP8 and STEP35, when the operation switch 10 is turned off from on, the cooking stove changes to the "operation state". The process then advances to STEP9 in FIG. 5.

On the other hand, in STEP35, the process advances to STEP36 when the 4-second timer times up, that is, when in STEP201 in FIG. 12, the operation switch 10 is turned on from off and then remains on for at least 5 seconds. The controller 30 then brings the cooking stove into a "child lock state" in which the switches of the operation portion 6 cannot be operated. The controller 30 thus lights the lock display portion 17 and activates the buzzer 18. The "child lock state" is cleared when the operation switch 10 is turned on from off and then remains on for at least 4 seconds.

Figure 5:
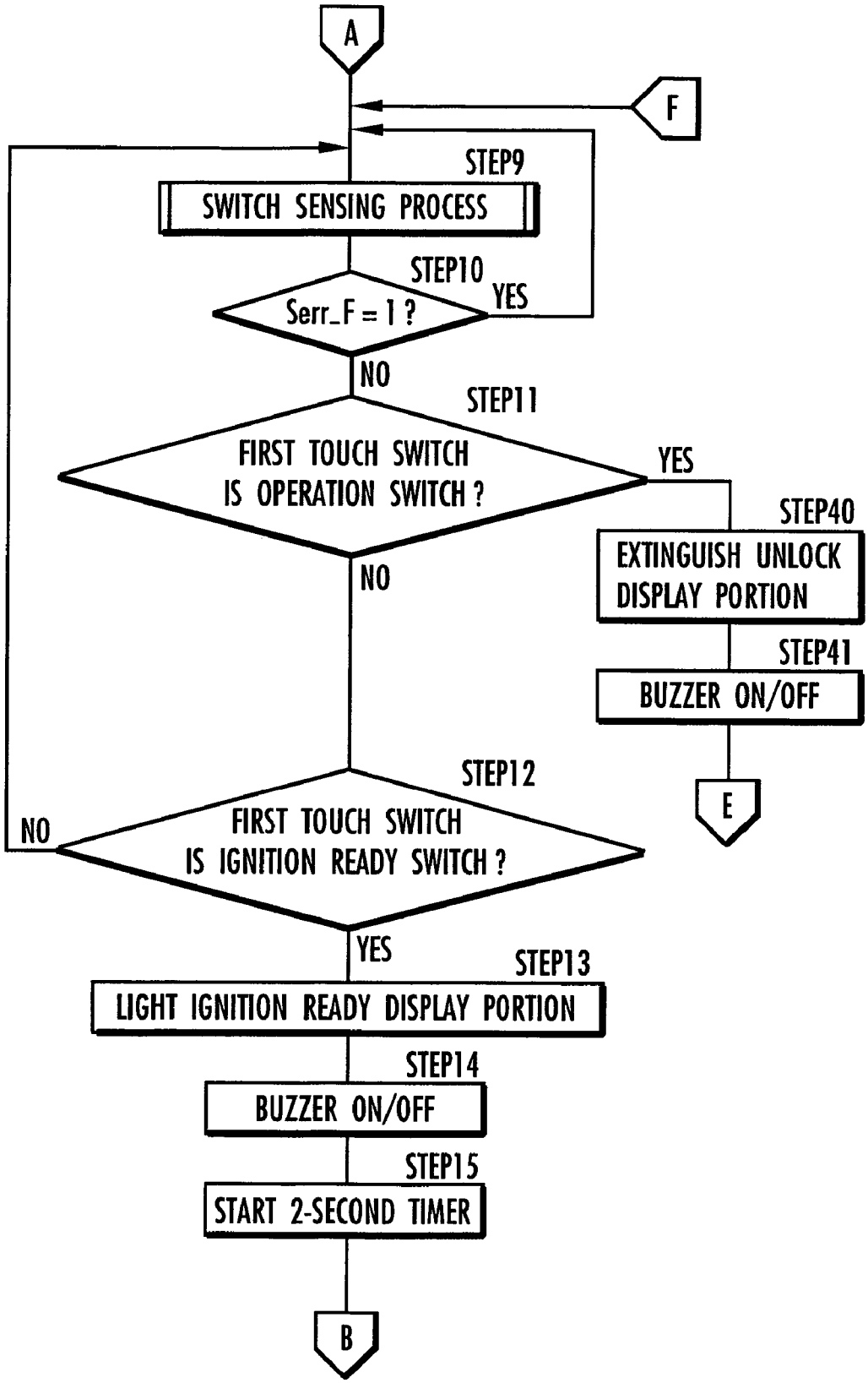
FIG. 5 is a flowchart of the process for igniting the burner.

In STEP9 in FIG. 5, the controller 30 executes the "switch sensing process" subroutine. In STEP10, if the error sensing flag Serr_F has been set (if it is assumed that any touch switch has been turned on by a factor different from the user's operation), the process branches to STEP9. The controller 30 then executes the "switch sensing process" subroutine.

On the other hand, if the controller determines in STEP 10 that the error sensing flag Serr_F has been reset (if it is assumed that any touch switch has been turned on by a factor different from the user's operation), the process branches to STEP11. The controller 30 determines whether or not the first touch switch in the "switch sensing process" in STEP9 is the operation switch 10. When the first touch switch is the operation switch 10, the process branches to STEP40. The controller 30 then extinguishes the unlock display portion 16. In STEP41, the controller 30 activates the buzzer 18. The process then returns to STEP1 in FIG. 4, where the cooking stove enters the "standby state".

In STEP11, when the first touch switch is not the operation switch 10, the process advances to STEP12. The controller 30 then determines whether or not the first touch switch is the ignition ready switch 11*a*. If the first touch switch is not the ignition ready switch 11*a*, the process branches to STEP9. The controller 30 then executes the "switch sensing process" again.

On the other hand, in STEP12, when the first touch switch is the ignition ready switch 11*a*, the process advances to STEP13. STEP13 and STEP14 are executed by the lighting control means 32. In STEP13, the lighting control means 32 lights the ignition ready display portion 14*a*. In STEP14, the lighting control means 32 activates the buzzer 18 to notice the user that the cooking stove is in the "ignition ready state".

Figure 6:
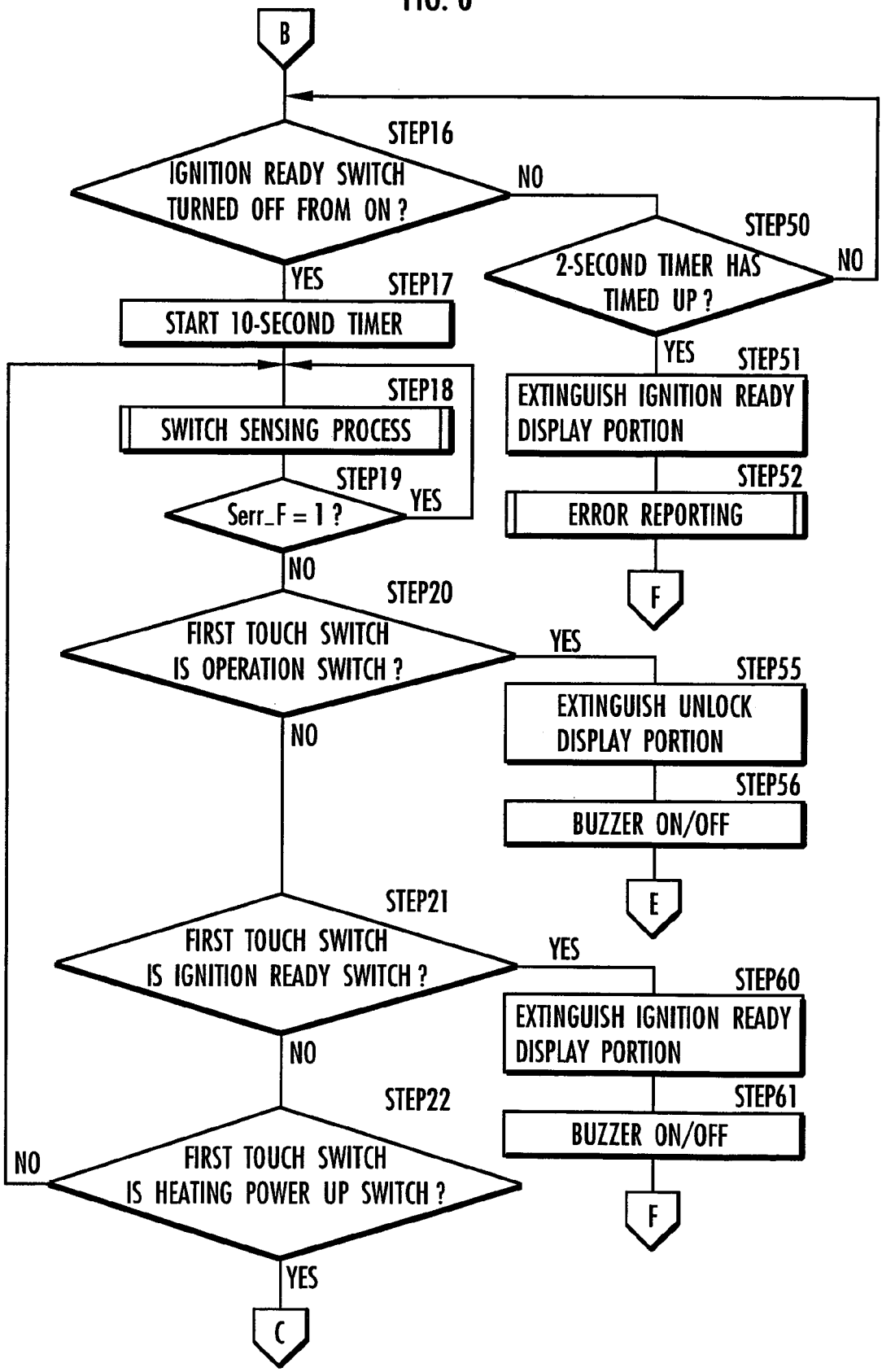
FIG. 6 is a flowchart of the process for igniting the burner.

The cooking stove actually enters the "ignition ready state" when the ignition ready switch 11*a* is turned off from on in STEP16 in FIG. 6, described later. However, by noticing the user that the cooking stove has entered the "ignition ready state" before this actually occurs, it is possible to allow the user to recognize that an operation of the ignition ready switch 11*a* has been accepted.

Then, in STEP15, the controller 30 starts a 2-second timer. The process then advances to STEP16. The controller 30 then executes a loop consisting of STEP16 and STEP50. While determining in STEP50 whether or not the 2-second timer has timed up, the controller 30 waits for the ignition ready switch 11*a* to be turned off from on in STEP16.

In STEP50, when the 2-second timer times up, the ignition ready switch 11*a* has remained on for at least 2 seconds. It is thus assumed that the ignition ready switch 11*a* has been turned on by a factor different from the user's operation, for example, a boiling-over cooking material. Accordingly, in this case, the process advances from STEP50 to STEP51. The lighting control means 32 extinguishes the ignition ready display portion 14*a*. In STEP52, the lighting control section 32 performs the "error reporting" by blinking the ignition ready display portion 14*a* and activating the buzzer 18. The process advances to STEP9 in FIG. 5.

On the other hand, in STEP16, when the ignition ready switch 11*a* is turned off from on before the 2-second timer times up, it is assumed that the ignition ready switch 11*a* has been turned on from off and then off again by the user's operation. Thus, in this case, the process advances to STEP17, where the cooking stove enters the "ignition ready state". The controller 30 starts a 10-second timer in STEP17 and executes the "switch sensing process" in STEP18.

In STEP19, the controller 30 determines whether or not the error sensing flag Serr_F has been set (Serr_F=1). If the error sensing flag Serr_F has been set (the controller 30 determines in the "switch sensing process" that any switch in the operation portion 6 has performed erroneous sensing), the process returns to STEP18. The controller 30 then executes the"switch sensing process" again. In this case, an "ignition process" in STEP26 in FIG. 7, described later, is inhibited.

On the other hand, in STEP19, if the error sensing flag Serr_F has been reset (Serr_F=0) (the controller 30 determines in the "switch sensing process" that any switch in the operation portion 6 has been operated by the user), the process advances to STEP20. In STEP20, when the switch in the "switch sensing process" is the operation switch 10, the process branches to STEP55. The lighting control means 32 extinguishes the unlock display portion 16 in STEP55 and activates the buzzer 18 in STEP56. The process advances to STEP1 in FIG. 4. Thus, the cooking stove returns to the "standby state".

In STEP21, when the first touch switch in the "switch sensing process" is the ignition ready switch 11*a*, the process branches to STEP60. Then, the lighting control means 32 extinguishes the lighting ready display portion 14*a* in STEP60 and activates the buzzer 18 in STEP61. The process returns to STEP9 in FIG. 5. The cooking stove thus enters the "operation state".

Figure 7:
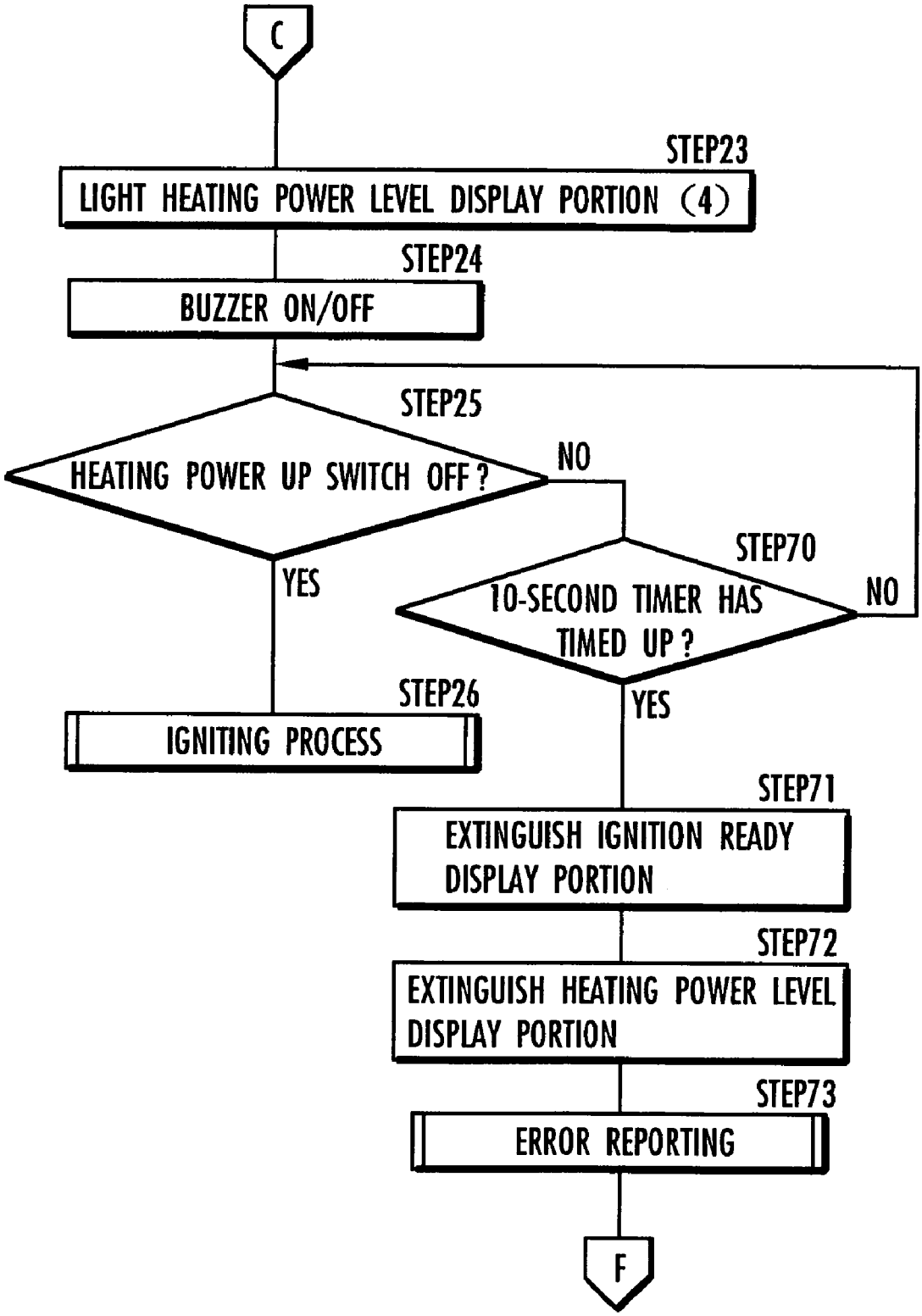
FIG. 7 is a flowchart of the process for igniting the burner.

In STEP22, when the first touch switch in the "switch sensing process " is the heating power up switch 13*a*, the process advances to STEP23 in FIG. 7. On the other hand, in STEP22, when the first touch switch is not the heating power up switch 13*a*, that is, the first touch switch in the "switch sensing process" in STEP18 is neither the operation switch 10 nor the ignition ready switch 11*a* nor the heating power up switch 13*a*, the process returns to STEP18. The controller 30 executes the "switch sensing process" again.

STEP23 and STEP24 in FIG. 7 are executed by the lighting control means 32. In STEP23, the lighting control means 32 lights the heating power level display portion 15*a* at the level 4 (heating power level for a lighting process). In STEP24, the lighting control means 32 activates the buzzer 18. The controller 30 then executes a loop consisting of STEP25 and STEP70. While determining in STEP70 whether or not a 10-second timer has timed up, the controller 30 waits for the heating power up switch 13*a* to be turned off in STEP25.

In STEP70, when the 10-second timer times up, the heating power up switch 13*a* has remained on for at least 10 seconds. It is thus assumed that the heating power up switch 13*a* has been turned on from off by a factor different from the user's operation, for example, a boiling-over cooking material. Accordingly, in this case, the process advances from STEP70 to STEP71. The lighting control means 32 extinguishes the ignition ready display portion 14*a*. In STEP72, the lighting control portion 32 extinguishes the heating power level display portion 15*a*. In STEP73, the lighting control portion 32 performs the "error reporting" by blinking the ignition ready display portion 14*a* and activating the buzzer 18. The process advances to STEP9 in FIG. 5.

On the other hand, in STEP25, when the heating power up switch 13*a* is turned off from on before the 10-second timer times up, it is assumed that the heating power up switch 13*a* has been turned on from off and then off again by the user's operation. Thus, in this case, the process advances to STEP26, where the controller 30 executes a "process for igniting" the left burner 4*a*.

The "igniting process" is executed by the heating control means 31 (see FIG. 3). The heating control means 31 first actuates the igniter 43*a* to cause spark discharge from an ignition electrode. The heating control means 31 then opens the gas source valve 40 and the left burner open and close valve 41*a*. The heating control means 31 further sets the left burner heating power adjusting valve 42*a* at the heating power level 4. The heating control means 31 then ignites the left burner 4*a*.

FIGS. 8 to 11 are flowcharts showing a process executed when any switch in the operation portion 6 is turned on from off while the left burner 4*a* is in operation.

Figure 8:
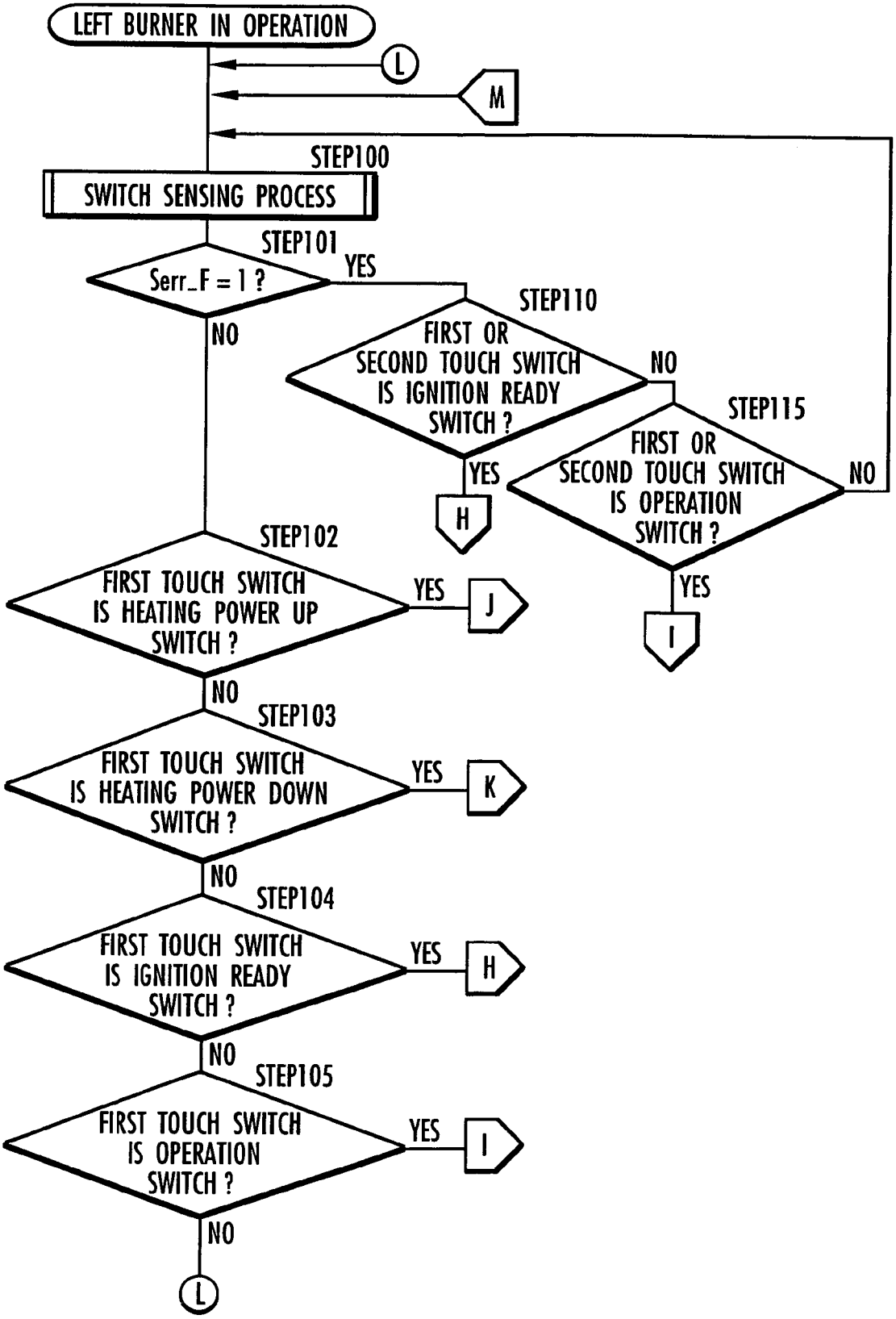
FIG. 8 is a flowchart showing various processes executed while the burner is in operation.
Figure 9:
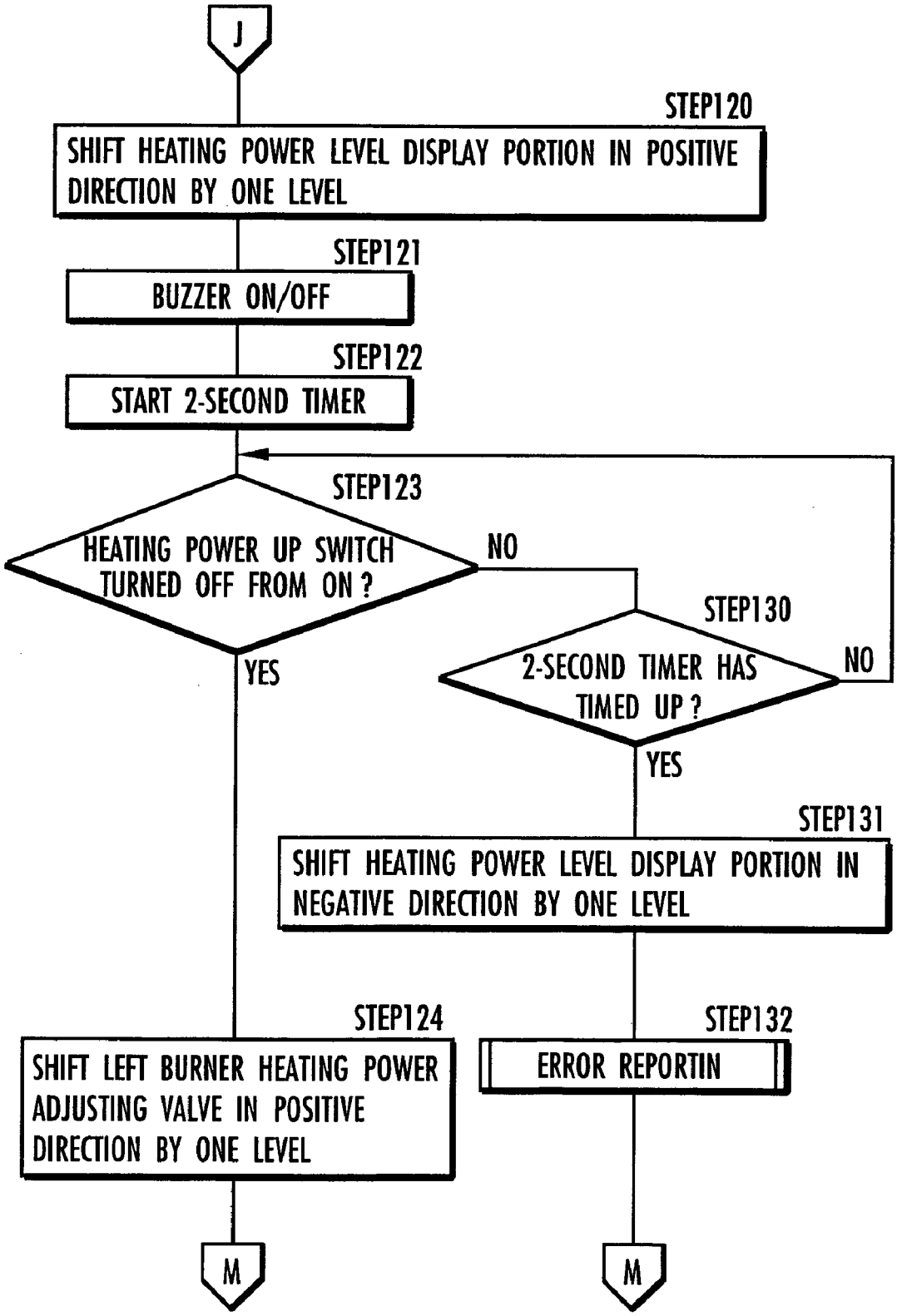
FIG. 9 is a flowchart showing various processes executed while the burner is in operation.

In STEP100 in FIG. 8, the controller 30 executes the "switch sensing process". Then, in STEP101, the controller 30 determines whether or not the error sensing flag Serr_F has been set. If the error sensing flag Serr_F has been set (the controller 30 determines in the "switch sensing process" that any switch in the operation portion 6 has performed erroneous sensing), the process branches to STEP110. In STEP110, the controller 30 determines whether or not the first or second touch switch in the "switch sensing process" in STEP100 is the ignition ready switch 11*a*.

Figure 11:
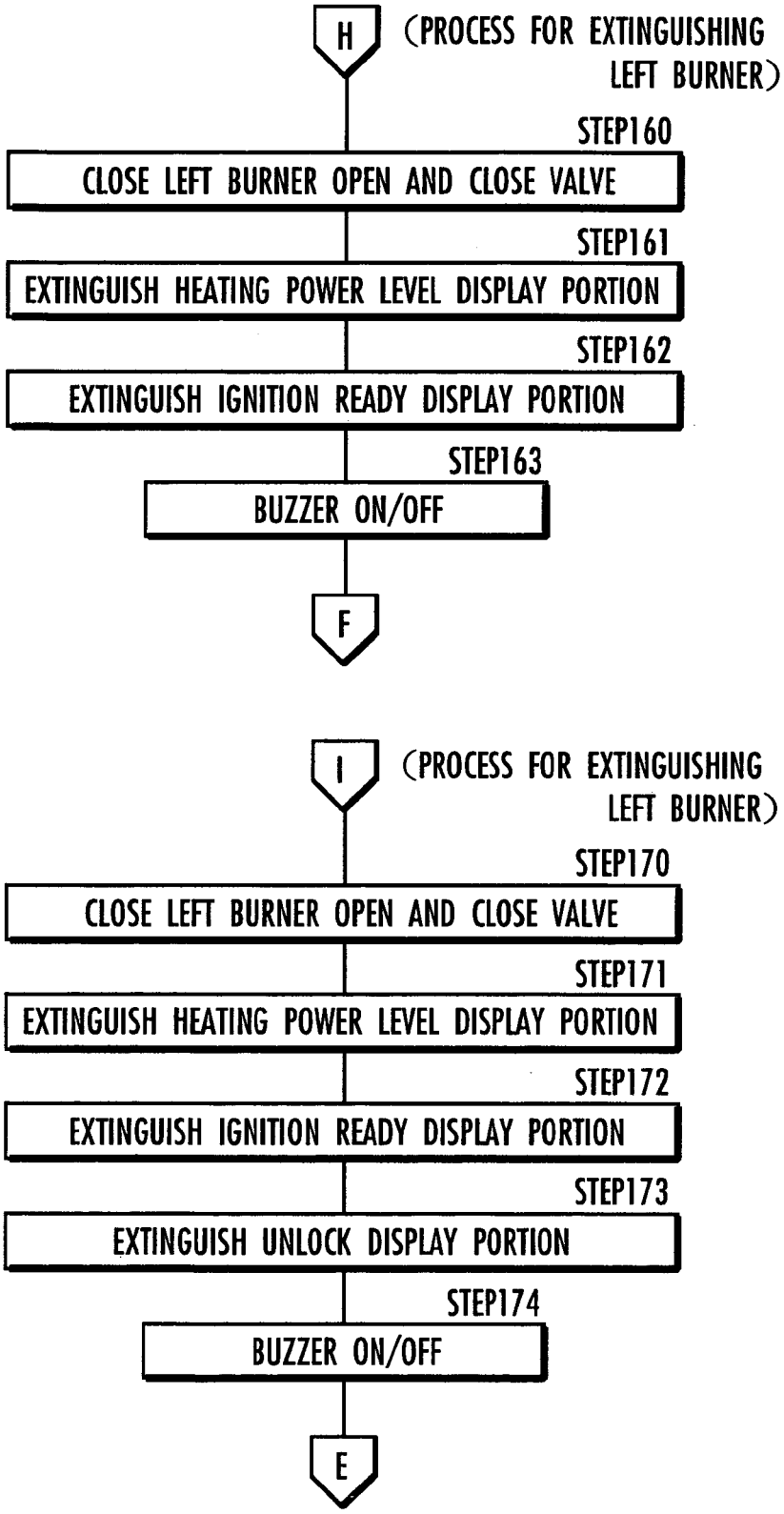
FIG. 11 is a flowchart showing various processes executed while the burner is in operation.

In STEP 10, when the first or second touch switch is the ignition ready switch 11, the process advances to STEP160 in FIG. 11. STEP160 is executed by the heating control means 31. The heating control means 31 closes the left burner open and close valve 41*a* to extinguish the left burner 4*a*. STEP161 to STEP163 are executed by the lighting control means 32. The lighting control means 32 extinguishes the heating power level display portion 15*a* in STEP161, extinguishes the ignition ready display portion 14*a* in STEP162, and activates the buzzer 18 in STEP163. The process then returns to STEP9 in FIG. 5.

Thus, when the ignition ready switch 11*a* is turned on from off while the left burner 4*a* is in operation, the left burner 4*a* is extinguished even if the error sensing flag Serr_F is set during the "switch sensing process" (the controller determines that any switch has performed erroneous sensing). Thus, the user can extinguish the left burner 4*a* quickly by simultaneously operating the ignition ready switch 11*a* and another touch switch.

In STEP110, when the first or second touch switch is not the ignition ready switch 11*a*, the process branches to STEP115. When the controller 30 determines that the first or second touch switch in STEP110 is the operation switch 10, the process branches to STEP170 in FIG. 11.

STEP170 is executed by the heating control means 31. The heating control means 31 closes the left burner open and close valve 41*a* to extinguish the left burner 4*a*. STEP171 to STEP174 are executed by the lighting control means 32. The lighting control means 32 extinguishes the heating power level display portion 15*a* in STEP171 and extinguishes the ignition ready display portion 14*a* in STEP172. The lighting control means 32 extinguishes the unlock display portion 16 in STEP173 and activates the buzzer 18 in STEP174. The process then returns from STEP174 to STEP1 in FIG. 4.

Thus, when the operation switch 10 is turned on from off while the left burner 4*a* is in operation, the left burner 4*a* is extinguished even if the error sensing flag Serr_F is set during the "switch sensing process" (the controller determines that any switch has performed erroneous sensing). Thus, the user can extinguish the left burner 4*a* quickly by simultaneously operating the ignition ready switch 11*a* and another touch switch.

In STEP115, when the first or second touch switch is not the operation switch, the process branches to STEP115. The controller 30 then executes the "switch sensing process" again. When the error sensing flag Serr_F has been set in the "switch sensing process", and if neither of the first nor second touch switches is the ignition ready switch 11*a* nor the operation switch 10, no process is executed on the left burner 4*a*.

In STEP101, if the error sensing flag Serr_F has been reset (Serr_F=0), the process advances to STEP102. The controller 30 determines whether or not the first touch switch in the "switch sensing process" is the heating power up switch 13*a*. When the first touch switch is the heating power up switch 13*a*, the process advances to STEP120 in FIG. 9.

STEP120 and STEP121 are executed by the lighting control means 32. In STEP120, the lighting control means 32 increases the number of lighted lighting portions in the heating power level display portion 15*a* by one. In STEP121, the lighting control means 32 activates the buzzer 18 to notice the user that the operation of the heating power up switch 13*a* has been accepted. The controller 30 then executes a loop consisting of STEP123 and STEP130. While determining in STEP130 whether or not the 2-second timer has timed up, the controller 30 waits for the heating power up switch 13*a* to be turned off from on in STEP123.

In STEP130, when the 2-second timer times up, the heating power up switch 13*a* has remained on for at least 2 seconds. It is thus assumed that the heating power up switch 13*a* has been turned on from off by a factor different from the user's operation, for example, a boiling-over cooking material. Accordingly, in this case, the process advances from STEP130 to STEP131. In STEP131, the lighting control means 32 reduces the number of lighted lighting portions in the heating power level display portion 15*a* by one. In STEP132, the lighting control portion 32 performs the "error reporting" by blinking the ignition ready display portion 14*a* and activating the buzzer 18. The process advances to STEP100 in FIG. 8. The controller 30 thus prevents the heating power of the left burner 4*a* from being increased when the heating power up switch 13*a* is turned on from off by a factor different from the user's operation.

On the other hand, in STEP123, when the heating power up switch 13*a* is turned off from on before the 2-second timer times up, the process advances to STEP124. STEP124 is executed by the heating control means 31. The heating control means 31 increments, by one, the opening degree of the left burner heating power adjusting valve 42*a* to increase the heating power of the left burner 4*a*. The process then returns to STEP100 in FIG. 8.

Figure 10:
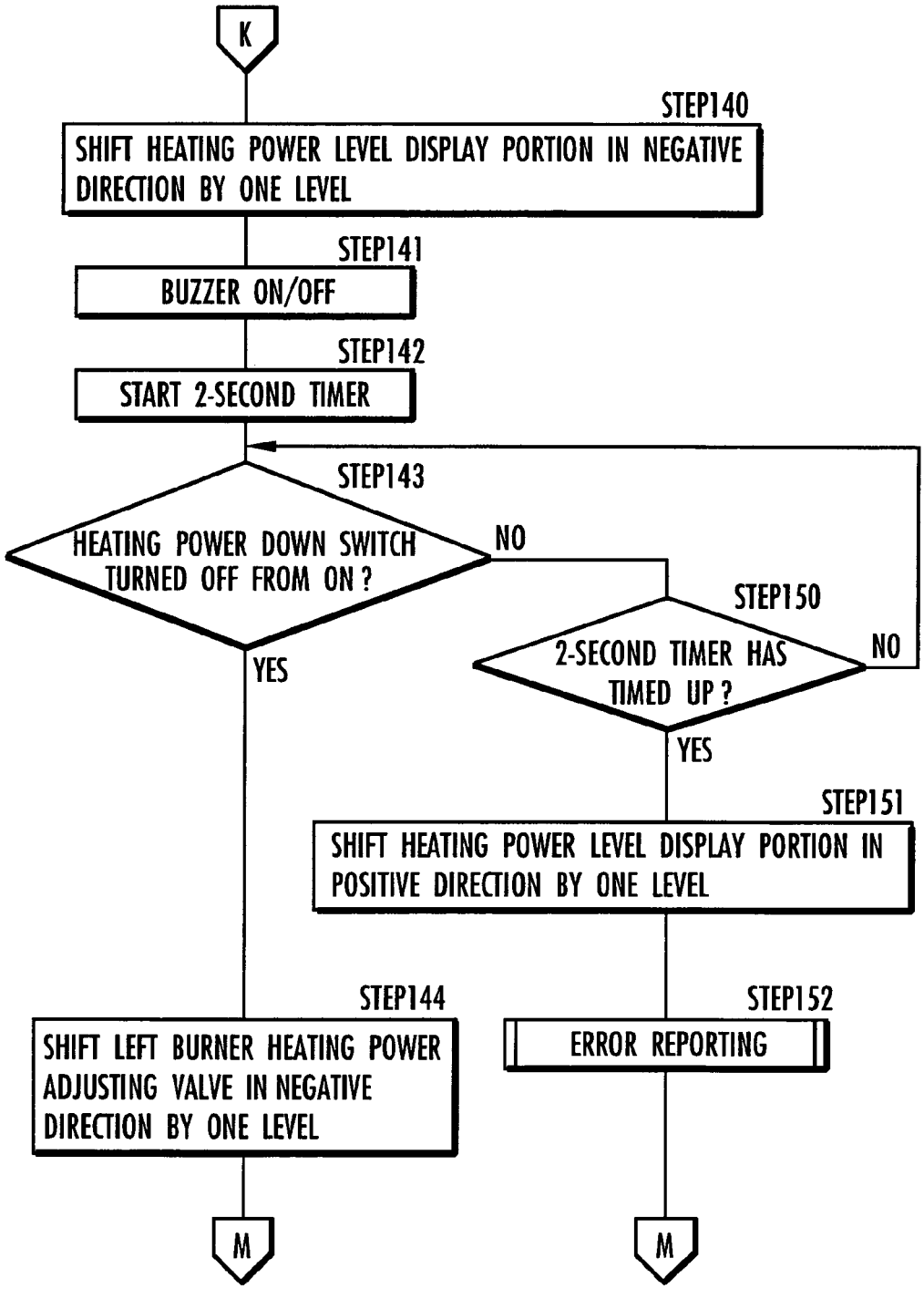
FIG. 10 is a flowchart showing various processes executed while the burner is in operation.

In STEP103 in FIG. 8, when the first touch switch in the "switch sensing process" is the heating power down switch 12*a*, the process branches to STEP140 in FIG. 10. STEP140 and STEP141 are executed by the lighting control means 32. In STEP140, the lighting control means 32 reduces the number of lighted lighting portions in the heating power level display portion 15*a* by one. In STEP141, the lighting control means 32 activates the buzzer 18 to notice the user that the operation of the heating power down switch 12*a* has been accepted.

While determining in STEP150 whether or not the 2-second timer has timed up, the controller 30 waits for the heating power down switch 12*a* to be turned off from on in STEP143.

In STEP150, when the 2-second timer times up, the heating power down switch 12*a* has remained on for at least 2 seconds. It is thus assumed that the heating power down switch 12*a* has been turned on from off by a factor different from the user's operation, for example, a boiling-over cooking material. Accordingly, in this case, the process advances from STEP150 to STEP151.

STEP151 and STEP152 are executed by the lighting control means 32. In STEP151, the lighting control means 32 increases the number of lighted lighting portions in the heating power level display portion 15*a* by one. In STEP152, the lighting control portion 32 performs the "error reporting" by blinking the ignition ready display portion 14*a* and activating the buzzer 18. The process advances to STEP100 in FIG. 8. The controller 30 thus prevents the heating power of the left burner 4*a* from being reduced when the heating power down switch 12*a* is turned on from off by a factor different from the user's operation.

On the other hand, in STEP143, when the heating power down switch 12*a* is turned of f from on before the 2-second timer times up, the process advances to STEP144. STEP144 is executed by the heating control means 31. The heating control means 31 decrements, by one, the opening degree of the left burner heating power adjusting valve 42*a* to reduce the heating power of the left burner 4*a*. The process then returns to STEP100 in FIG. 8.

In STEP104 in FIG. 8, when the first touch switch in the "switch sensing process" is the ignition ready switch 11*a*, the process advances to STEP160 in FIG. 11. Then, a process such as extinction of the left burner 4*a* by the heating control means 31 is executed. In STEP105 in FIG. 8, when the first touch switch in the "switch sensing process" is the operation switch 10, the process advances to STEP170 in FIG. 11. Then, a process such as extinction of the left burner 4*a* by the heating control means 31 is executed. On the other hand, in STEP104, when the first touch switch is not the operation ready switch 10*a*, the process returns to STEP100. No process is executed on the left burner 4*a*.

In the present embodiment, the cooking stove is shown which comprises the gas burners 4*a* and 4*b* as heating means according to the present invention. However, the present invention is applicable to a cooking stove comprising another type of heating means such as an electric heater.

In the present embodiment, the cooking stove is shown which adopts the electrical capacitance touch switch as a touch switch according to the present invention. However, the type of the touch switch is not limited to this. The present invention is applicable to a cooking stove that adopts a photo switch comprising an infrared light emitting and receiving portions or a mechanical contact type touch switch such as a tact switch.

Further, in the present embodiment, the cooking stove is shown which comprises the glass top plate 2, composed of heat resistant glass, as a top plate according to the present invention. However, depending on the type of the touch switch, the present invention is applicable to a cooking stove comprising a top plate composed of another material such as stainless steel.

In the present embodiment, as shown in FIG. 12, in the "switch sensing" subroutine, the controller determines whether or not the second touch switch is turned on from off in STEP210 before the 1-second timer times up in STEP203. The controller thus determines whether or not the touch switch in the operation portion 6 has been turned on from off by a boiling-over cooking material. In contrast, as shown in FIG. 13, when the second touch switch remains on from off in STEP230 after the first touch switch is turned on from off in STEP221 and before it is turned off from on again in STEP222, the controller may determine that the touch switch in the operation portion 6 has been turned on from off by a boiling-over cooking material.

Furthermore, in the present embodiment, as shown in FIG. 2, the heating power up switches 13*a* and 13*b*, arranged to the right of the ignition ready switches 11*a* and 11*b*, are also used as ignition switches (corresponding to heating start switches according to the present invention) that instruct the burners 4*a* and 4*b* to be ignited. However, as shown in FIG. 14(*a*), other touch switches 51 and 52 may be arranged to the left and right, respectively, of the ignition switch 50. In this case, when a boiling-over cooking material flows to the ignition switch from its right or left, at least two touch switches including the ignition switch are turned on from off.

Thus, in the "switch sensing process" subroutine shown in FIGS. 12 and 13, when the controller recognizes that any touch switch has performed erroneous sensing and the ignition switch is turned on from off by a factor different from the user's operation, an igniting process can be prevented from being executed on the burner 4*a* or 4*b*. Moreover, as shown in FIG. 14(*b*), touch switches 53 and 54 may be arranged above and below, respectively, of the ignition switch 50. Then, if a boiling-over cooking material flows to the ignition switch 50 from above or below, the controller recognizes in the "switch sensing process" subroutine that any touch switch has performed erroneous sensing. This makes it possible to prevent an igniting process from being executed on the burner 4*a* or 4*b*.

What is claimed is:

1. A cooking stove comprising:

a plurality of touch switches provided on a top plate so that a user can operate the touch switches, the top plate covering a top surface of a cooking stove main body accommodating heating means, the touch switches sensing an object which contacts or approaches the top surface of the top plate; and control means for determining whether each of the touch switches is in a sensing state or a non-sensing state, and executing a predetermined process which is set for each of the touch switches according to the determined results, wherein when a first touch switch in the plurality of touch switches changes from the non-sensing state to the sensing state, the control means inhibits a predetermined process set for the first touch switch from being executed until a predetermined time passes after the first touch switch changes to the sensing state, wherein when a second touch switch in the plurality of touch switches which is different from the first touch switch changes from the non-sensing state to the sensing state before the predetermined time passes, the control means inhibits execution of the predetermined process set for the first touch switch and a predetermined process set for the second touch switch, and wherein when all the touch switches except the first touch switch are kept in the non-sensing state until the predetermined time passes, the control means executes the predetermined process set for the first touch switch.

2. The cooking stove according to claim 1, further comprising an actuation start switch included in the plurality of touch switches for an instruction on start of actuation of the heating means, wherein the first or second touch switch is the actuation start switch, and the predetermined process set for the actuation start switch is a process for starting actuation of the heating means.

3. The cooking stove according to claim 1, further comprising:

heat quantity varying means for varying heat quantity generated by the heating means; and a heat quantity varying switch included in the plurality of touch switches for an instruction on varying heat quantity generated by the heating means, wherein the first touch switch or the second touch switch is the heat quantity varying switch, and the predetermined process set for the heat quantity varying switch is a process for varying heat quantity generated by the heating means using the heat quantity varying means.

4. The cooking stove according to claim 1, further comprising an actuation start switch included in the plurality of touch switches for an instruction on start of actuation of the heating means, and an actuation start ready switch included in the plurality of switches for an instruction on switching between an actuation start ready state in which it is permitted to instruct on start of actuation of the heating means using the actuation start switch and an actuation start disabled state in which it is prohibited to instruct on start of actuation of the heating means using the actuation start switch, wherein the first touch switch or the second touch switch is the actuation start ready switch, and the predetermined process set for the actuation start ready switch is a process for switching between the actuation start ready state and the actuation start disabled state.

5. The cooking stove according to claim 2, wherein at least two of the plurality of touch switches are arranged around the actuation start switch in proximity to each other.

6. The cooking stove according to claim 4, wherein at least two of the plurality of touch switches are arranged around the actuation start switch in proximity to each other.

7. A cooking stove comprising:

a plurality of touch switches provided on a top plate so that a user can operate the touch switches, the top plate covering a top surface of a cooking stove main body accommodating heating means, the touch switches sensing an object which contacts or approaches the top surface of the top plate; and control means for determining whether each of the touch switches is in a sensing state or a non-sensing state, and executing a predetermined process which is set for each of the touch switches according to the determined results, wherein when a first touch switch in the plurality of touch switches changes from the non-sensing state to the sensing state, the control means inhibits a predetermined process set for the first touch switch from being executed until the first touch switch changes from the sensing state to the non-sensing state, wherein when a second touch switch of the plurality of touch switches which is different from the first touch switch changes from the non-sensing state to the sensing state before the first touch switch changes from the sensing state to the non-sensing state, the control means inhibits execution of the predetermined process set for the first touch switch and a predetermined process set for the second touch switch, and wherein when all the touch switches except the first touch switch are kept in the non-sensing state until the first touch switch changes from the sensing state to the non-sensing state, the control means executes the predetermined process set for the first touch switch.

8. The cooking stove according to claim 7, further comprising an actuation start switch included in the plurality of touch switches for an instruction on start of actuation of the heating means, wherein the first or second touch switch is the actuation start switch, and the predetermined process set for the actuation start switch is a process for starting actuation of the heating means.

9. The cooking stove according to claim 7, further comprising:

heat quantity varying means for varying heat quantity generated by the heating means; and a heat quantity varying switch included in the plurality of touch switches for an instruction on varying heat quantity generated by the heating means to be varied, wherein the first touch switch or the second touch switch is the heat quantity varying switch, and the predetermined process set for the heat quantity varying switch is a process for varying heat quantity generated by the heating means using the heat quantity varying means.

10. The cooking stove according to claim 7, further comprising an actuation start switch included in the plurality of touch switches for an instruction on start of actuation of the heating means, and an actuation start ready switch included in the plurality of switches for an instruction on switching between an actuation start ready state in which it is permitted to instruct on start of actuation of the heating means using the actuation start switch and an actuation start disabled state in which it is prohibited to instruct on start of actuation of the heating means using the actuation start switch, wherein the first touch switch or the second touch switch is the actuation start ready switch, and the predetermined process set for the actuation start ready switch is a process for switching between the actuation start ready state and the actuation start disabled state.

11. The cooking stove according to claim 8, wherein at least two of the plurality of touch switches are arranged around the actuation start switch in proximity to each other.

12. The cooking stove according to claim 10, wherein at least two of the plurality of touch switches are arranged around the actuation start switch in proximity to each other.

* * * * *